United States Patent [19]

McDonald et al.

[11] 4,261,298

[45] Apr. 14, 1981

[54] VAPOR GENERATING TECHNIQUE

[75] Inventors: Bertrand N. McDonald, Clearwater, Fla.; Donald C. Schluderberg, Lynchburg, Va.

[73] Assignee: The Babcock & Wilcox Company, New Orleans, La.

[21] Appl. No.: 913,413

[22] Filed: Jun. 7, 1978

[51] Int. Cl.[2] ..... F22B 1/06

[52] U.S. Cl. ..... 122/32; 122/34; 122/488; 122/491

[58] Field of Search ..... 122/32, 33, 34, 488, 122/491, 406 ST

[56] References Cited

U.S. PATENT DOCUMENTS

| | | | |
|---|---|---|---|
| 3,154,140 | 10/1964 | Esselman et al. | 122/34 |
| 3,329,130 | 7/1967 | Cochran | 122/34 |
| 3,923,008 | 12/1975 | Beckmann et al. | 122/34 |
| 3,949,710 | 4/1976 | Reisacher | 122/34 |

*Primary Examiner*—Henry C. Yuen

*Attorney, Agent, or Firm*—Robert J. Edwards; Robert H. Kelly

[57] ABSTRACT

A method of operating a vapor generating system, including a once-through vapor generator, wherein wet vapor is generated in the upper portion of the load range and superheated vapor is generated in the lower portion of the load range is disclosed. Generated vapor is passed through an external and remote moisture separator. Superheated vapor is desuperheated by liquid injection as it passes from the vapor generator to the moisture separator.

4 Claims, 1 Drawing Figure

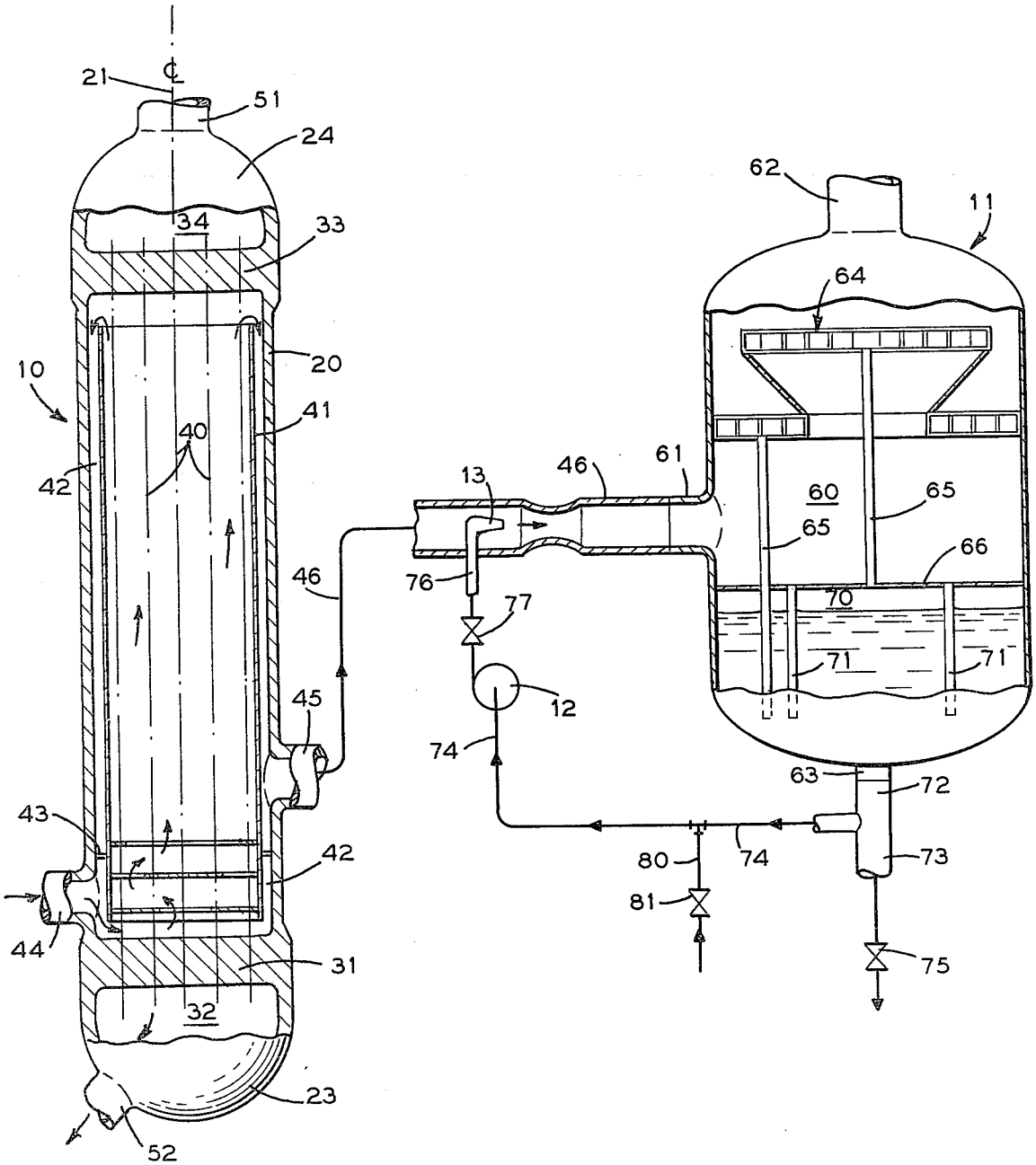
21
51
24
34
33
10
20
41
40
42
46
45
43
42
44
31
32
23
52
62
11
64
13
46
61
60
65
65
66
76
77
70
71
71
12
74
63
72
80
74
73
81
75

VAPOR GENERATING TECHNIQUE

BACKGROUND OF THE INVENTION

This invention relates to a method of operating a vapor generator system, in particular, operating a vapor generating system including a once-through vapor generator producing wet vapor at high loads and superheated vapor at low loads. More particularly, this invention relates to a method of operating the steam generating system of a steam-electric power station. Still more particularly, this invention relates to a method of operating a steam generating system, including a once-through steam generator, in a water-cooled nuclear reactor power station.

The vapor generating system of a power plant typically includes one or more vapor generators, a turbine, a condenser, a secondary coolant system and interconnecting piping. In water-cooled nuclear power stations, the vapor generators provide the interface between a reactor (primary) coolant system and the secondary coolant loop, that is, the vapor generating system. Heat generated by a reactor is transferred from the reactor coolant in the vapor generators to vaporize a secondary coolant, usually feedwater, and produce steam. The steam passes from the vapor generator to the turbine where some of its energy is used to drive the turbine. Steam exhausted from the turbine is condensed, regeneratively reheated, and pumped back to the vapor generators as feedwater.

In most pressurized water cooled nuclear steam supply systems, the steam exiting the vapor generators is routed directly to the turbine as dry or superheated steam. When once-through vapor generators are utilized, the steam is often superheated and provided at substantially constant pressure at the turbine throttle over the entire load range.

A typical once-through vapor generator employs a vertical, straight tube bundle, cylindrical shell design with shell side boiling. Hot reactor coolant enters the vapor generator through a top nozzle, flows downward through the tubes, wherein it transfers its heat, and exits through bottom nozzles before passing onto the reactor. The shell, the outside of the tubes, and the tubesheets form the vapor-producing section or secondary side of the vapor generator. On the secondary side, subcooled secondary coolant flows downward into an annulus between the interior of the shell and a tube bundle shroud, and enters the tube bundle near the lower tubesheet. As the secondary coolant flows upwardly through the tube bundle, heat is transferred from the counterflowing reactor coolant within the tubes, and a vapor and liquid mixture is generated on the secondary side ranging from zero quality at the lower tubesheet to substantially dry, one hundred percent quality vapor. The mixture becomes superheated in the upper portion of the tube bundle. The superheated vapor flows downwardly through an upper annulus between the shell and the tube bundle shroud, passes through a vapor outlet, and then onto the turbine. This arrangement insures zero moisture (superheated) vapor at the turbine throttle without the need of bulky steam drying equipment integrally associated with the vapor generators which, in nuclear power stations, are housed within a generally crowded environment in a reactor containment building where space is at a premium. Further detailed description of a once-through vapor generator may be found in U.S. Pat. No. 3,385,268.

The once-through vapor generating concept permits easily controlled operation with both constant average primary coolant temperature and constant steam pressure at the turbine throttle. To change load, the once-through vapor generator relies on a change in the proportion of boiling to superheating length in the tube bundle, that is, a trade-off between nucleate boiling and superheating. In designing and operating vapor generators, it is vital to make efficient use of the heat transfer surface. Hence, it is desirable to maintain nucleate boiling over as wide a range of vapor qualities as possible since nucleate boiling is characterized by high heat transfer coefficients and makes possible the generation of vapor with minimum heating surface. Typically, at high loads the once-through vapor generator heat transfer surface is approximately 75% in nucleate boiling and 25% in superheating; while at low loads the distribution is approximately 5% nucleate boiling and 95% superheating. Control is achieved by regulating feedwater flow to maintain constant output pressure, letting the distribution between superheating and boiling surface automatically vary as a function of load. One disadvantage of this concept is the relatively low heat transfer rate, or effectiveness, of the superheating surface at maximum load which requires more heating surface than would be needed if the heat were all transferred in the nucleate boiling mode. However, superheating is basically required to preclude moisture carry-over to the turbine, particularly during load change excursions.

Due to the single-pass, nonconcentrating characteristics of once-through vapor generators, essentially all of the soluble contaminants in the incoming secondary coolant exit from the unit dissolved in the superheated vapor, in moisture droplets that may be entrained and carried in suspension by slightly superheated vapor. In contrast, recirculating vapor generators concentrate solids in the feedfluid, and limit such concentrations by controlled blowdown. Hence, blowdown is not required in once-through vapor generators, but high quality secondary coolant is required.

In steam systems, feedwater is cleaned, for example, by condensate demineralizers prior to its introduction into the steam generator. Some contaminants remain in the feedwater regardless of the feedwater treatment utilized. Small quantities of common contaminants in feedwater chemistry can be tolerated and feedwater chemical specifications make appropriate allowances therefor. However, if the feedwater contaminants exceed limits allowed by the chemical specifications, either due to variations during normal operating conditions or during load transients, contaminants may be deposited within the turbine where corrosion damage can result due to the buildup and concentration of solids, particularly sodium compounds. Allowable sodium concentrations may be as low as 1 ppb. Unfortunately, a greater proportion of sodium compounds to total solids seems to be present when condensate polishing is used.

Thus, there exists a need to develop operating techniques for vapor generating systems including once-through vapor generators which further minimize contaminant deposition in the turbine and which minimize the disadvantages of utilizing steam generator heat transfer surface for superheating.

SUMMARY OF THE INVENTION

According to the present invention, a method of operating a once-through vapor generating system comprises passing, in the upper portion of the load range, a vaporizable fluid through a once-through vapor generator to generate a wet vapor, and passing the wet vapor to a moisture separator, external and separate from the vapor generator, to separate the moisture from the vapor. In the lower portion of the load range, the vaporizable fluid is converted into a superheated fluid which is passed from the vapor generator and subjected to vaporizable liquid injection upstream of the moisture separator to form a wet vapor; and, moisture is separated from the wet vapor within the moisture separator.

In a preferred embodiment, the method is utilized to operate a steam generating system, and, in the lower portion of the load range, a water level is maintained in a reservoir within the moisture separator to provide a source for the liquid injection into the superheated steam.

Operation of the vapor generating system with zero superheat in the upper portion of the load range allows for removal of contaminants associated with the moisture phase in the moisture separator. Liquid injection into the superheated vapor, and subsequent demoisturizing in the lower portion of the load range, allows for removal of contaminants transported from the vapor generator by the superheated vapor.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DESCRIPTION OF THE PREFERRED EMBODIMENTS

The present invention is directed to methods of operating a vapor generating system. In accordance with the principles of the invention, a vapor generating system including a once-through vapor generator may be operated in the upper portion of the load range to produce vapor without superheat. Those skilled in the art will understand that changes may be made in the physical form of an apparatus of the exemplary system described hereinafter without departing from the scope of the invention described and claimed herein.

The sole drawing is a schematic representation of a portion of a vapor generating system having a once-through vapor generator 10, a remote moisture separator 11, external to and separated from the vapor generator, a pump 12, and a desuperheating spray device 13.

The vapor generator 10 includes a vertically elongated pressure shell 20 of circular cross section, with a longitudinal center line 21, closed at its opposite ends by a lower head member 23 and an upper head member 24. Within the vapor generator, a transversely arranged lower tubesheet 31 is integrally attached to the shell 20 and lower head member 23 forming, in combination with the lower head member, a chamber 32. At the opposite end of the vapor generator, a transversely arranged upper tubesheet 33, integrally attached to the shell 20 and upper head member 24, forms, in combination with the upper head, a chamber 34. A bundle of straight tubes 40 extends between tubesheets 31 and 33. A cylindrical shroud 41, which generally circumscribes the tube bundle 40, is disposed transversely spaced from the interior of the shell 20 to form an annulus 42 therebetween. The extremities of the shroud are longitudinally spaced from the tubesheets. The annulus 42 is divided into upper and lower portions by an annular plate 43 which is integrally attached at its outer edge to the shell 20 and at its inner edge to the shroud 41. A nozzle 44 provides means for a feedfluid inlet into the lower portion of the annulus 42 and a nozzle 45 provides means for passage of fluid from the upper portion of the annulus 42. A pipe line 46 connects nozzle 45 with the moisture separator 11.

In the upper head member 24, a nozzle 51 provides means for passage of a fluid into chamber 34, through the tubes 40 leading to chamber 32, and out a nozzle 52 in the lower head member 23.

As shown in the Figure, the illustrated exemplary moisture separator 11 is a vertical cylindrical tank constructed with elliptically dished heads at each end. The moisture separator is provided with a central fluid inlet 61, leading to a space 60, a vapor outlet 62 in its upper head, and a liquid outlet 63 in its lower head. One or more vapor-liquid separating devices 64, such as those shown in U.S. Pat. No. 3,324,634, are internally disposed across the cross-section of the moisture separator 11 so that all inflowing vapor from inlet 61 passes therethrough. Liquid separated in the vapor-liquid separating devices is collected and drained via drain lines 65. A horizontal circular divider plate 66 crosses the shell at an elevation below the vapor inlet and is integrally attached to the wall of the moisture separator tank. The drain lines 65 traverse the space 60 between the liquid-vapor separating devices and the divider plate, sealingly penetrate the plate and extend into a volume or reservoir 70 formed by the plate and the lower end of the moisture separator tank. Other drain lines 71, originating at apertures in the divider plate, similarly extend into the volume 70 below the plate.

A liquid line 72, arranged in fluid communication with the liquid outlet 63, has branch lines 73 and 74. A blowdown valve 75 is provided in line 73 to remove excess liquid and control the amount of dissolved solids therein. Branch line 74 leads to the suction end of the pump 12. A discharge line 76 extending from the discharge end of the pump includes a regulating valve 77, and is provided with means for spraying the pumped liquid into pipe line 46. A makeup line 80 having a makeup regulating valve 81 is connected to branch line 74 to provide an alternate source of liquid to the pump suction. The makeup line is also utilized to establish an initial liquid level in the reservoir 70 and provide liquid makeup during operation in the lower portion of the load range.

During normal operation, hot primary coolant received from a pressurized water reactor other heat source enters chamber 34 through nozzle 51. From chamber 34, the primary coolant flows downwardly through the tubes of the tube bundle 40 into chamber 32 and exits the vapor generator via nozzle 52.

Secondary fluid, flows into the lower portion of the annular 42 through nozzle 44, and thence into the adjacent portion of the volume outside of the tubes where it is heated, as it flows upward, by heat transferred from the hot primary coolant flowing through the tubes. Vapor is concurrently drawn from the vapor generator through nozzle 45 and is routed to the moisture separator 11 via pipe line 46. Demoisturized steam leaves separator 11 from nozzle 62 and thence flows through connected piping to the steam turbine not shown.

Load and load range, as used in the specification and claims is intended to refer to reactor power conditions, for example, the rated thermal output of the reactor. Wet mixture shall be understood to denote a mixture of a vapor and its liquid. Quality is defined as the mass fraction or percentage of vapor in a mixture of vapor and liquid. Superheated vapor shall be understood to be vapor at some temperature above the saturation temperature; and degrees of superheat shall be used to denote the difference in temperature between a super-heated vapor and its saturation temperature for like pressure. Zero superheat, as used herein, shall be understood to cover vapor generating outlet conditions ranging from 0.90 quality to a few degrees of superheat at full load.

In accordance with the principles of the invention, in the upper portion of the load range the once-through vapor generator is operated, at substantially constant vapor pressure, such that boiling is essentially nucleate over the entire length of the tube bundle 40 so as to generate a vapor with vapor generator outlet conditions ranging from a quality of 90% to essentially zero degrees superheat at full load. Operation of the once-through vapor generator at essentially zero superheat or with quality above 90% at full load results in superheat operation at lower loads if vapor pressure and average primary coolant temperature are held constant. Thus, in the lower portion of the load range, vapor is generated with up to 60° F. of superheat in order to maintain a constant turbine throttle pressure and constant average primary coolant temperature.

Studies have shown that soluble solids—including well-known feedwater contaminants such as sodium sulfate ($Na_2SO_4$), sodium chloride (NaCl), and sodium hydroxide (NaOH)—are much more soluble in saturated water than saturated steam, and concentrate in the water phase whenever the two phases are in intimate contact, in, for example, the pressure ranges utilized in steam cycles associated with typical pressurized water reactor steam generators.

For a steam generating system, in the upper end of the load range, a moisture separator such as 11, which as shown in the FIGURE is located downstream of the vapor generator 10, removes any excess moisture that may normally pass with the vapor from the once-through vapor generator (via pipe line 46) or that may result from load changes or abnormal conditions. Thus, in wet mixtures with high quality, contaminants carried by the liquid phase can be collected with the separated liquid in the remote moisture separator 11. The wet mixture flows from pipe line 46 into space 60 in the moisture separator and then passes upwardly through the vapor-liquid separating devices 64. Moisture separated from the wet mixture drains from the separating devices 64 through drain lines 65 to prevent reentrainment and is discharged into the reservoir 70 below the divider plate 66. The dried vapor passes from the separating devices to the turbine (not shown) via vapor outlet 62. Small amounts of liquid which are separated from the wet mixture in the volume 60 by momentum, may be drained through drain lines 71 which also serve to vent the reservoir. Liquid in the reservoir 70 may be blown down from the system, either continuously or intermittently, by operation of blowdown valve 75 in line 73.

In the lower portion of the load range, liquid is withdrawn from the reservoir 70 by the pump 12 and is sprayed or injected, via a desuperheating spray device 13 installed in pipe line 46, into the super-heated vapor passing from the vapor generator 10 to the moisture separator 11. A sufficient rate of liquid is injected into the superheated vapor to eliminate all the superheat and form a two-phase wet vapor mixture which tends to concentrate contaminants in the liquid phase. The moisture in the wet vapor is separated in the moisture separator from the mixture as described heretofore. The energy of the superheat is converted into an additional quantity of vapor thereby minimizing reduction in cycle efficiency. Sodium and other soluble salts can be concentrated in an external moisture separator reservoir to a significantly higher limit than is tolerable in vapor generators having integral moisture separators; hence, a high level of contaminants is allowable in the feedfluid. Additional liquid can be supplied to the pump 12 or introduced into the reservoir via valve 81 in makeup line 80. The pump 12 could also be operated throughout the load range.

A number of advantages are attendant with operating a vapor generating system, as described, at constant vapor pressure. For a given reactor output, reduced vapor generator heat transfer area is required since the boiling mode is essentially completely nucleate at full load. Alternatively, primary coolant system temperature may be reduced for a given reactor output, vapor pressure and vapor generator size thereby yielding increased critical heat flux margins where the heat source is a pressurized water-cooled reactor. Furthermore, operating as described minimizes the possibility of contaminant carryover to the turbine during rapid load changes.

Operating a once-through vapor generator at zero degrees superheat may, as an alternative to reducing vapor generator size for a given load rating, be used to increase steam pressure to improve cycle efficiency. Thus, the vapor generating system cycle design could account for the elimination of superheat by a compensating increase in turbine throttle pressure. Thus, it has been calculated that for a nominal 3600 MWt pressurized water-cooled nuclear reactor station, the pressure of the steam leaving the vapor generator can be increased from 1060 psia to 1172 psia by reducing superheat from 50° F. to zero. For a 3800 MWt plant, pressure can be increased from 1060 psia to 1121 psia by reducing superheat from 35° F. to zero. Hence, a reduction in feedwater temperature combined with zero superheat operation will improve station heat rate by allowing a still higher operating pressure.

Other advantages of operating once-through vapor generating systems in accordance with the principle of the invention will be apparent to those skilled in the art.

Alternative embodiments of the invention include returning part of the separated moisture from the moisture separator to the once-through vapor generator, for example, in order to maintain higher feed temperatures during emergency conditions or during periods of low level contaminant concentration in the moisture separator reservoir.

In the preferred embodiment, liquid will generally be injected into the vapor upstream of the moisture separator whenever more than a few degrees of superheat exist.

The embodiments of the invention in which an exclusive property or privilege is claimed are defined as follows:

1. A method of operating a vapor generating system, at substantially constant vapor pressure over a load range, including a once-through vapor generator in which heating fluid is directed through the tubes at substantially constant flow rate, and a moisture separator external and separate from the vapor generator which comprises: passing, in the upper portion of the load range of the system, a vaporizable fluid in one pass through the vapor generator in indirect heat exchange relation with a heating fluid to convert the vaporizable fluid into a wet vapor, and passing the wet vapor to the moisture separator to separate the moisture from the vapor; passing, in the lower portion of the load range, the vaporizable fluid in one pass through the vapor generator in indirect heat exchange relation with a heating fluid to convert the vaporizable fluid into a superheated vapor, passing the superheated vapor from the vapor generator to the moisture separator, providing vaporizable liquid injection into the superheated vapor between the vapor generator and the moisture separator, and separating the moisture from the wet vapor in the moisture separator.

2. A method as recited in claim 1, wherein the vaporizable fluid is water.

3. A method as recited in claim 2, further comprising maintaining a liquid level in the moisture separator.

4. A method as recited in claim 3, wherein the vaporizable liquid injected into the superheated vapor is drawn from the liquid level in the moisture separator.

* * * * *